US007963609B2

(12) United States Patent
Jinkun

(10) Patent No.: US 7,963,609 B2
(45) Date of Patent: Jun. 21, 2011

(54) CHAIR ARM THAT IS ROTATABLY FOLDED AND ASSEMBLY-FREE

(75) Inventor: Zhou Jinkun, Zhejiang (CN)

(73) Assignee: Global Furniture (Zhejiang) Co. Ltd., Zhejiang (CN)

( * ) Notice: Subject to any disclaimer, the term of this patent is extended or adjusted under 35 U.S.C. 154(b) by 56 days.

(21) Appl. No.: 12/548,696

(22) Filed: Aug. 27, 2009

(65) Prior Publication Data

US 2010/0176642 A1 Jul. 15, 2010

(30) Foreign Application Priority Data

Jan. 14, 2009 (CN) ..... 2009 2 0002333 U

(51) Int. Cl.
*A47C 7/54* (2006.01)

(52) U.S. Cl. ..... 297/411.32; 297/411.3; 297/411.44

(58) Field of Classification Search ..... 297/411.3, 297/411.32, 411.44
See application file for complete search history.

(56) References Cited

U.S. PATENT DOCUMENTS 4,073,539 A * 2/1978 Caruso ..... 297/411.44 X
4,902,072 A * 2/1990 Chancellor, Jr. ..... 297/411.32
5,318,346 A * 6/1994 Roossien et al. ..... 297/411.44 X
5,924,769 A * 7/1999 Kao ..... 297/411.44
7,384,102 B2 * 6/2008 Chen et al. ..... 297/411.32
2009/0309407 A1 * 12/2009 Saito et al. ..... 297/411.32

* cited by examiner

*Primary Examiner* — Rodney B White

(74) *Attorney, Agent, or Firm* — Patent Procurement Services

(57) ABSTRACT

A chair arm is rotatably folded and assembly-free, which is applicable for a new type folding chair, said chair arm comprising a back panel pin, an arm, a fixation for the pin, and a connection screw. The back panel and the arm are connected through the screw via a screw hole formed on the top end of the arm with said screw hole being a rotation center. The pin is fixed on a side of the back panel, the fixation for the pin comprises an arm housing, an unlocking hand knob, a locking member, an elastic member and a fixation screw, a slide slot is formed on the inner side of the arm housing facing the back panel, when the back panel is rotated, the screw hole on the top end of the arm functions as a rotation center, the pin on the back panel contacts the locking member through the guide slot on the arm, the locking member slides inside the guide slot on the arm as acted on by the pin, when the pin enters into the inner side of the locking member, the lock member is reset as acted on by the elastic member, and the locking member and the guide slot on the arm form a locking hole for locking the back panel pin.

10 Claims, 3 Drawing Sheets

CHAIR ARM THAT IS ROTATABLY FOLDED AND ASSEMBLY-FREE

CROSS-REFERENCE TO RELATED APPLICATION

This application claims priority from Chinese Application 200920002333.2 filed on Jan. 14, 2009.

FIELD OF THE UTILITY MODEL

The present utility model relates to the technical field of office and living appliances, more particularly to the technical field of chairs, and specifically relates to a chair arm that is rotatably folded and assembly-free with the back panel thereof folded when not in use or during transportation and expanded when in use.

DESCRIPTION OF THE PRIOR ART

Chairs are one of people's most favorite seating arrangements, which have been used extensively in families, hotels, and conference rooms. Most of chair structures known in the art have a seat fixed on top of legs, arms fixed on both sides of the seat, and a back panel fixed on the back ends of the arms, i.e., the seat is fixedly connected with the back panel with no relative motion therebetween allowed. As a result, the drawback is that such a chair takes up a large space due to the height and thickness of the back panel, which is not convenient to use in a small office. In particular, it takes up a large space during storage and transportation and increases transportation cost, which does not fit for long distance storage and transportation. Moreover, it is easy to be hit and damaged during storage and transportation, causing losses to users; if the chair is disassembled during transportation and storage to reduce the occupied space, it needs to be re-assembled for use, which costs time and effort. Furthermore, the repeated disassembly and assembly tend to damage the parts thereof.

To save space, lower the transportation and storage cost, and save time and effort by eliminating the need for repeated disassembly and assembly, the Chinese patent for utility model ZL200420095162.X (the title of the patent: Office Chair) discloses an office chair with a foldable back panel, wherein a spring pin is formed on the back panel, an inclined slide track facing the back panel and a level through hole connected therewith are formed on the chair arm, said inclined slide track becomes deeper as it gets farther away from the level through hole. When the back panel is expanded, the spring pin thereon moves into the inclined slide track. As being squeezed by the inclined slide track, the spring pin gradually contracts, which is released and returns to normal after reaching the through hole. Consequently, the spring pin is inserted into said through hole to fix the back panel. When the back panel is to be folded, a tool is employed to press the spring pin located in the through hole from the outer side thereof to shorten the spring pin to a certain degree for the back panel to be rotated, which makes the spring pin disengage from the through hole and slide along the slide track until the back panel is completely folded, and the spring pin leaves the inclined track and returns to its original length.

The above patent for utility model has the following drawbacks: an extra tool is needed to press on the spring pin so as to fold the back panel. If there is no extra tool available on the site, it is impossible to fold the office chair; moreover, the back panel must be pushed at the same time when the spring pin is kept being pressed without releasing for folding. The operation is very inconvenient.

SUMMARY OF THE UTILITY MODEL

The object of the present utility model is to overcome the drawbacks of the above prior art and to provide a chair arm that is rotatably folded and assembly-free. Said chair arm that is rotatably folded and assembly-free has an ingenious design and is easy to use. The back panel can be folded when not in use or during transportation, or expanded when in use, to consequently save space and lower the transportation and storage cost, and there is no need for repeated disassembly and assembly, which saves time and effort.

In order to attain the above object, the chair arm that is rotatably folded and assembly-free according to the present utility model comprises:

Said chair arm that is rotatably folded and assembly-free, comprising a back panel and an arm, characterized in that it further comprises a pin and a means for fixing the pin, said back panel and said arm are rotatably connected, said pin is fixed on a side of said back panel, said means for fixing the pin comprises a housing, an unlocking hand knob, a locking member, and an elastic member, said housing is fixed inside said arm, a slide slot is formed on the surface of said housing facing the back panel, a guide slot is formed on the other side of said housing opposite to said surface, said guide slot is connected with said slide slot, said locking member and said elastic member are disposed inside said guide slot, the two ends of said elastic member are disposed against said guide slot and said locking member, respectively, at least a part of said locking member traverses said slide slot to form a locking hole, said pin is disposed inside said locking hole, and said locking member is connected with said unlocking hand knob.

Preferably, said locking member is a crescent shaped member.

Preferably, said elastic member is a spring.

Preferably, said guide slot is a curved guide slot, said unlocking hand knob is a rotatable hand knob, and said rotatable hand knob is rotatably fixed with said housing.

Still preferably, said rotatable hand knob is a rotatable cap.

Preferably, a cam is formed on said locking member, a recess is formed on said unlocking hand knob, and said cam is disposed in said recess.

Preferably, said pin is fixed on the lower portion of said side of said back panel, and said housing is fixed on the lower back portion of said arm.

Preferably, said housing is integrally formed on said arm.

Preferably, said back panel is connected with said arm via a common axis.

Still preferably, said slide slot is a short section of curved slide track with the rotation axis of said arm and said back panel as the center.

Still preferably, a rivet head is formed on said side of said back panel, a screw hole is formed in said arm, and a screw runs through said screw hole and said rivet head.

The present utility model employs a pin plus a moveable check plate, i.e. a crescent shaped member. When the back panel is expanded, the pin enters into the slide slot, by squeezing the crescent shaped member, the pin enters into the bottom portion of the slide slot by passing through the slide slot. After the pin enters, the crescent shaped member resets as acted on by the spring and traverses the slide slot to form a locking hole to block the pin, and thus the back panel is fixed; when the back panel is to be folded, rotate the rotatable hand knob, which drives away the crescent shaped member and opens up the slide slot. Thereafter, the pin leaves the slide slot along with the rotation of the back panel, and thus the back panel is folded. The design is ingenious and it is easy to use. The back panel can be folded when not in use or during transportation, or expanded when in use, to consequently save space, lower the transportation and storage cost, and there is no need for repeated disassembly and assembly, which saves time and effort.

DETAILED DESCRIPTION OF THE UTILITY MODEL

Figure 1:
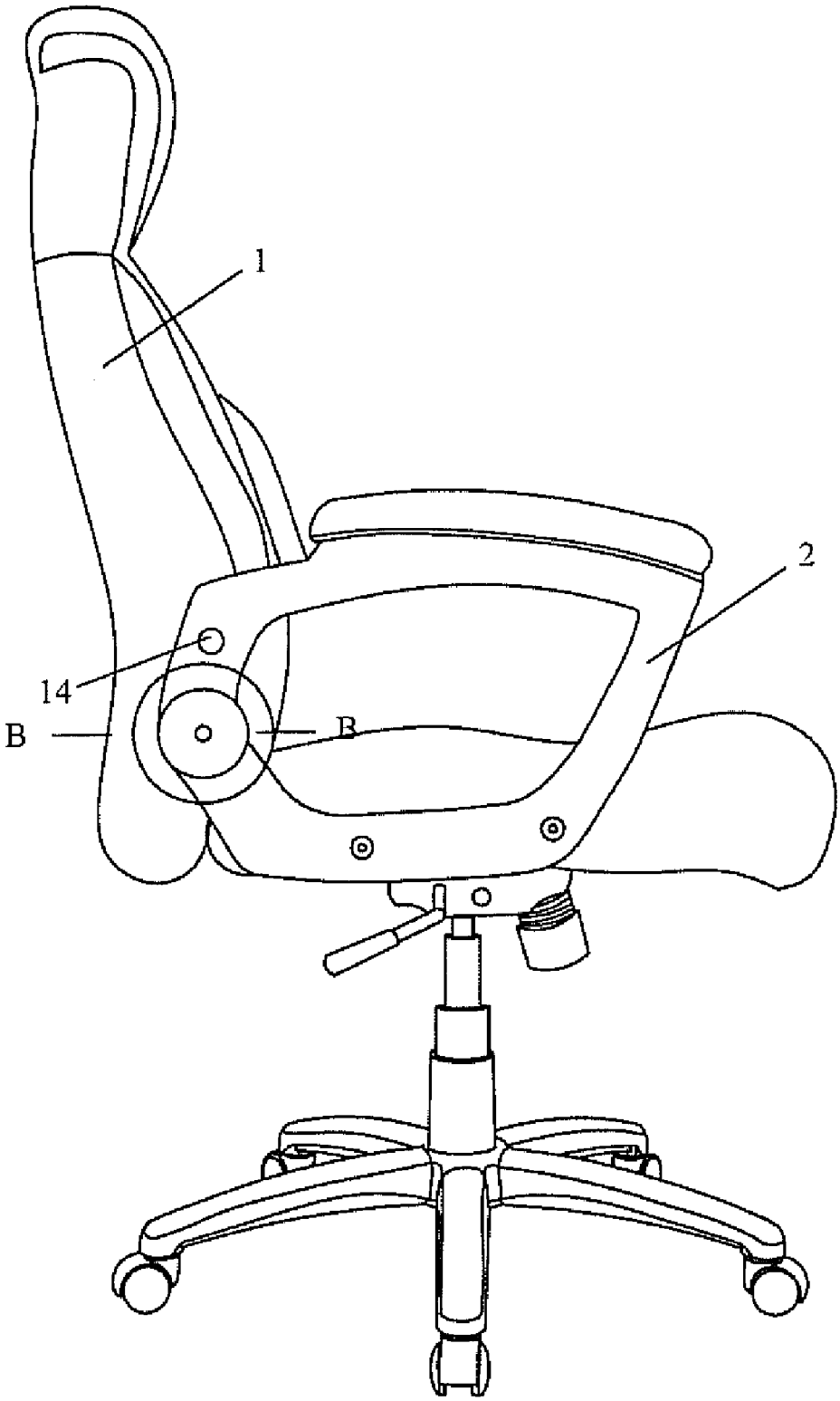
FIG. 1 is a front view of the appearance of the chair arm according to an embodiment of the present invention.
Figure 2:
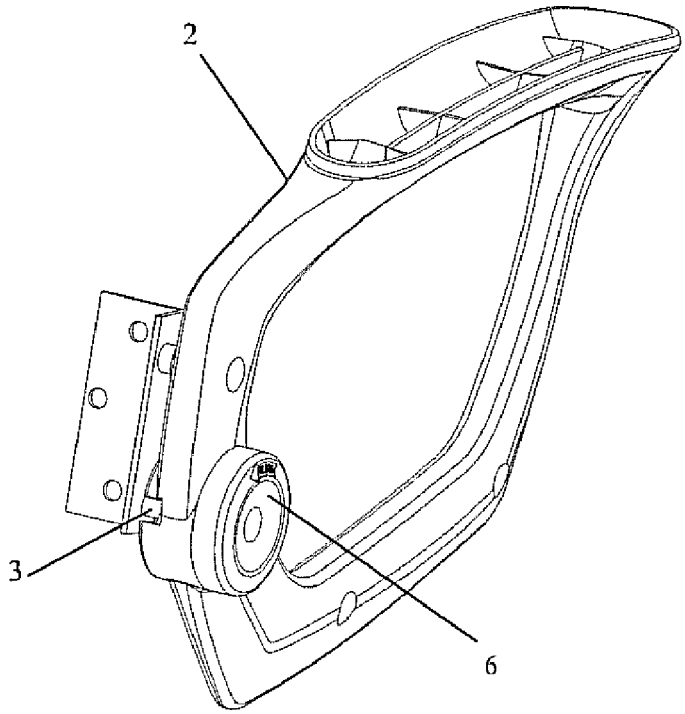
FIG. 2 is a detailed view of the locking state of the chair arm that is rotatably folded and assembly-free.
Figure 3:
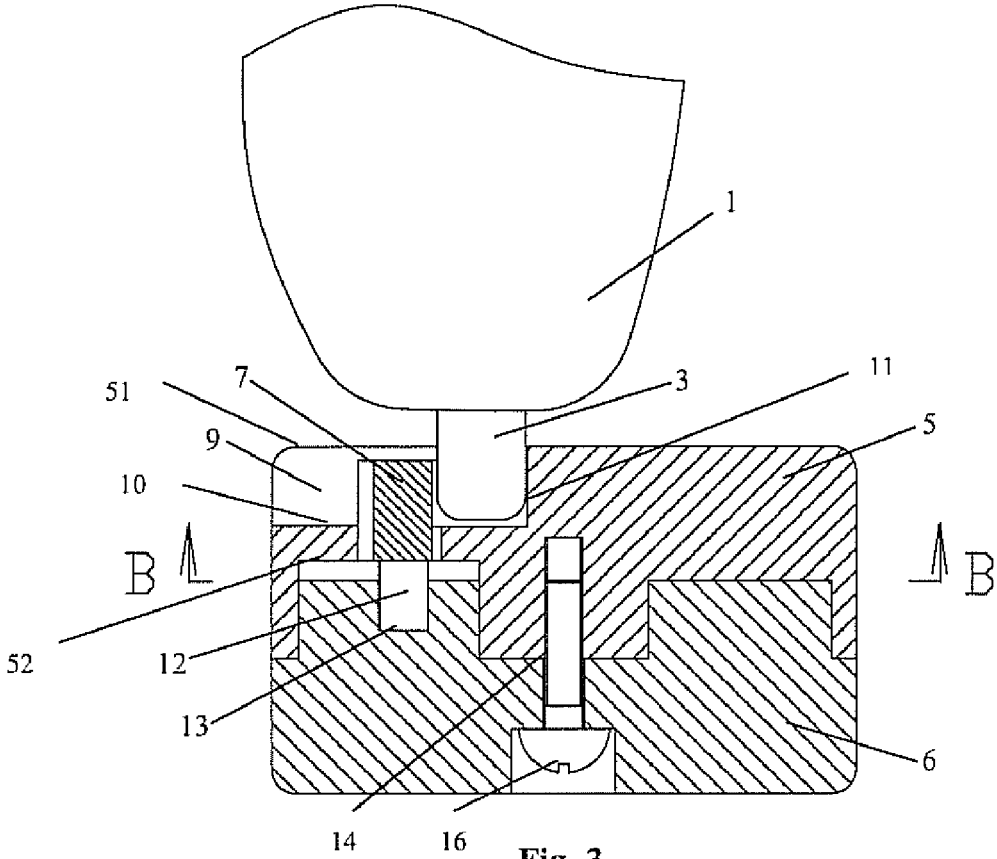
FIG. 3 is a partial sectional view taken on line B-B of FIG. 1.
Figure 4:
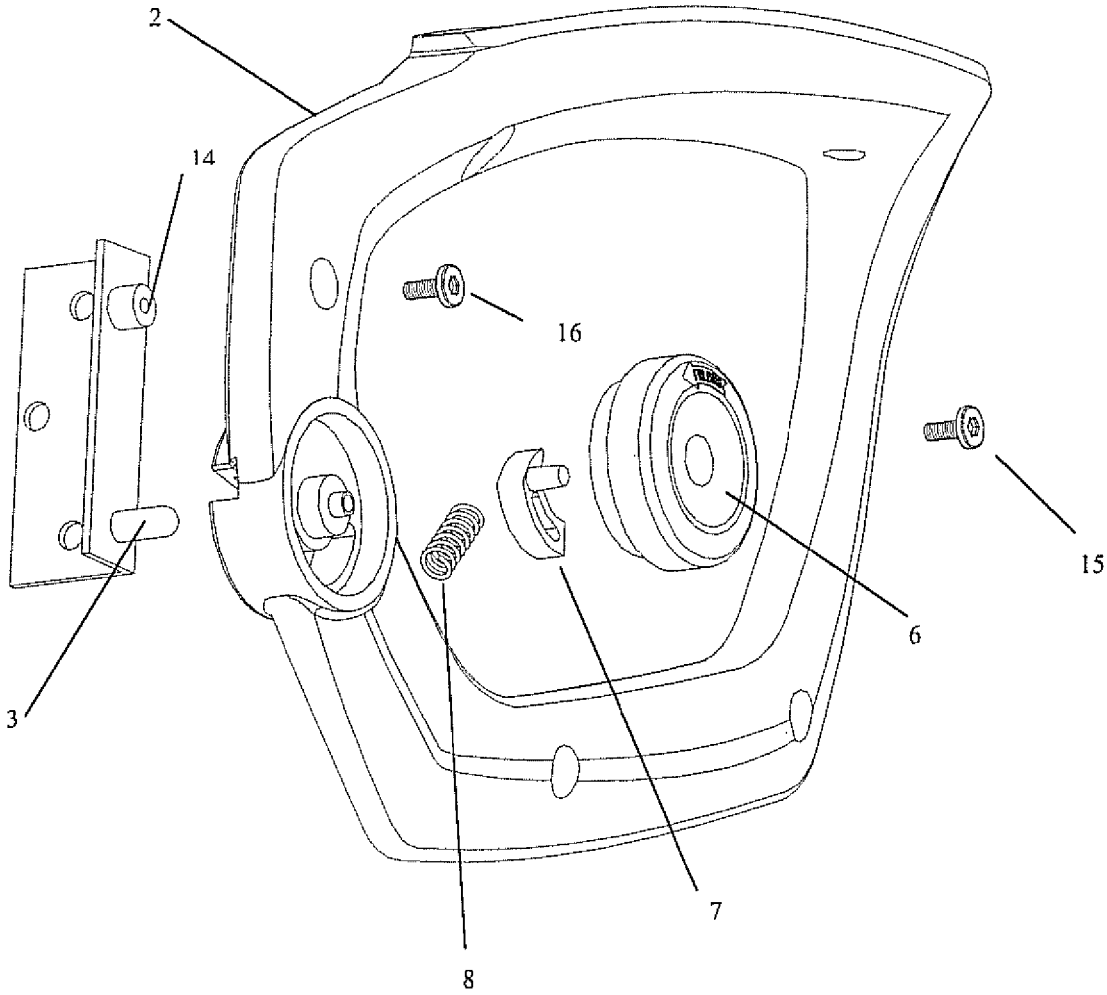
FIG. 4 is an exploded view of the chair arm according to an embodiment of the present invention.

The present invention relates to a chair arm that is rotatably folded and assembly-free, which is applicable for a new type folding chair, said chair arm comprising a back panel pin, an arm, a means for fixing the pin, and a connection screw. The back panel and the arm are connected through the screw via a screw hole formed on the top end of the arm with said screw hole being a rotation center. The pin is fixed on a side of the back panel, the means for fixing the pin comprises an arm housing, an unlocking hand knob, a locking member, an elastic member and a fixation screw, a slide slot is formed on the inner side of the arm housing facing the back panel, when the back panel is rotated, the screw hole on the top end of the arm functions as a rotation center, the pin on the back panel contacts the locking member through the guide slot on the arm, the locking member slides inside the guide slot on the arm as acted on by the pin, when the pin enters into the inner side of the locking member, the lock member is reset as acted on by the elastic member, and the locking member and the guide slot on the arm form a locking hole for locking the back panel pin. When the back panel is to be folded, the unlocking hand knob is rotated, the locking member slides inside the guide slot on the arm as driven by the unlocking hand knob to disengage from the locking with the pin, and the back panel can then be folded through rotation. The present utility model has an ingenious design and is easy to use. Its back panel can be folded during packaging and transportation so as to save space and lower the cost of packaging, transportation and storage. Moreover, a user can assemble just by rotating the back panel without using a screwdriver. There is no need for repeated disassembly and assembly, which saves time and effort.

The technical content of the present invention can be better understood through the following detailed description of an embodiment.

Please refer to FIG. 1-FIG. 4, the chair arm that is rotatably folded and assembly-free according to the present utility model comprises a back panel 1 and an arm 2, further comprises a pin 3 and a means for fixing the pin 4, said back panel 1 and said arm 2 are connected using a screw 16 through a screw hole 14 and are capable of rotating with the screw 16 as the rotation center, said pin 3 is fixed on a side of said back panel 1, said means for fixing the pin 4 comprises a housing 5, an unlocking hand knob 6, a locking member 7, a spring 8, and a connection screw 15, said housing 5 is fixed inside said arm 2, a slide slot 9 is formed on the surface 51 of said housing 5 facing said back panel 1, a guide slot 10 is formed on the other side 52 of said housing 5 opposite to said surface 51, said guide slot 10 is connected with said slide slot 9, said locking member 7 and said elastic member 8 are disposed inside said guide slot 10, the two ends of said elastic member 8 are disposed against said guide slot 10 and said locking member 7, respectively, at least a part of said locking member 7 traverses said slide slot 9 to form a locking hole 11, said pin 3 is disposed inside said locking hole 11, and said locking member 7 is connected with said unlocking hand knob 6.

Preferably, said locking member 7 is a crescent shaped member. In an embodiment of the present utility model, the outward curved surface of the crescent shaped member faces the exit of the slide slot 9, which can strengthen the effect to block the pin 3, and moreover, offers an automatic capability when the back panel 1 is expanded, i.e. by only rotating the back panel 1. When the back panel 1 is rotated, the pin 3 will squeeze the curved surface of the crescent shaped member and therefore compress the elastic member 8 that presses against the crescent shaped member, and thus enters into the bottom portion of the slide slot 9. Thereafter, the elastic member 8 will reset the crescent shaped member to block said pin 3 so that it is unable to retreat out of the locking hole 11.

In an embodiment of the present utility model, said elastic member 8 is a spring. Apparently, the elastic member 8 can also be other elastic members, such as an elastic body, etc.

Preferably, said guide slot 10 is a curved guide slot, said unlocking hand knob 6 is a rotatable hand knob, and said rotatable hand knob is rotatably fixed with said housing 5. In an embodiment of the present utility model, said rotatable hand knob is a rotatable cap.

Preferably, a cam 12 is formed on said locking member 7, a recess 13 is formed on said unlocking hand knob 6, and said cam 12 is disposed in said recess 13. In an embodiment of the present utility model, a cam 12 is formed on the crescent shaped member, a recess 13 is formed in the rotatable cap, and said cam 12 is disposed in said recess 13, the center of the rotatable cap is connected with said housing 5 via a screw. By rotating the rotatable cap, therefore, the crescent shaped member is driven to move inside the curved guide slot so that the slide slot 9 will be blocked or opened.

In an embodiment of the present utility model, said pin 3 is fixed on the lower portion of said side of said back panel 1, and said housing 5 is fixed on the lower back portion of said arm 2.

In an embodiment of the present utility model, said housing 5 is integrally formed on said arm 2. Of course, the housing 5 may also be fixed inside said arm 2.

Preferably, said back panel 1 is connected with said arm 2 via a common axis. In an embodiment of the present utility model, said slide slot 9 is a short section of curved slide track with the rotation axis of said arm 2 and said back panel 1 as the center to form a substantially U shaped slide slot, a rivet head is formed on said side of said back panel 1, a screw hole 14 is formed in said arm 2, and a screw runs through said screw hole 14 and said rivet head. With said screw as the rotation axis, the back panel 1 is capable of rotating with respect to said screw relative to the arm 2.

When using the chair arm that is rotatably folded and assembly-free according to the present utility model, the back panel 1 is expanded, the back panel 1 moves relative to the arm 2, the lower portion of the back panel 1 gradually approaches the lower back portion of the arm 2, the pin 3 enters into the slide slot 9, then the pin 3 squeezes the crescent shaped member to compress the spring that presses against the crescent shaped member, and thus enters into the bottom portion of the slide slot 9 by passing through the slide slot 9.

After the pin 3 enters, the crescent shaped member resets as acted on by the spring and traverses the slide slot 9 to form a locking hole 11 to block the pin 3, and thus the back panel 1 is fixed, as shown in FIG. 1; the back panel 1 can be folded when not in use or for transportation, the detailed process thereof is as follows: rotate said rotatable cap, which drives away the crescent shaped member and opens up the slide slot 9. Thereafter, rotate the back panel 1, and the pin 3 slides out of the slide slot 9 along with the rotation of the back panel 1, and thus the back panel 1 is folded.

In summary, the chair arm that is rotatably folded and assembly-free according to the present utility model has ingenious design and is easy to use. The back panel can be folded when not in use or during transportation, or expanded when in use, to consequently save space, lower the transportation and storage cost, and there is no need for repeated disassembly and assembly, which saves time and effort.

In the Specifications, the present utility model is described with reference to specific embodiments. However, various modifications and variations can apparently be made without departing from the scope and spirit of the present utility model. Therefore, the Specifications and Drawings shall be interpreted as being descriptive instead of restrictive.

The invention claimed is:

1. A chair arm that is rotatably folded and assembly-free with elegant appearance and ingenious structural design, comprising:

a pin;

a fixation for the pin;

a back panel; and an arm are rotatably connected, said pin is fixed on a side of said back panel, said fixation for the pin comprises:

an arm housing, an unlocking hand knob, a locking member, and an elastic member having two ends, said arm housing is fixed inside said arm, a guide slot is formed on a surface of said housing facing the back panel, a guide slot is formed on an opposing side of said arm housing opposite to said surface, said guide slot is connected with a slide slot, said locking member and said elastic member are disposed inside said slide slot, the two ends of said elastic member are disposed against said guide slot and said locking member, respectively, at least a part of said locking member traverses said guide slot to form a locking hole, said pin is disposed inside said locking hole, and said locking member is connected with said unlocking hand knob.

2. The chair arm that is rotatably folded and assembly-free as set forth in claim 1, wherein said locking member is a crescent shaped member.

3. The chair arm that is rotatably folded and assembly-free as set forth in claim 1, wherein said elastic member is a spring.

4. The chair arm that is rotatably folded and assembly-free as set forth in claim 1, wherein said guide slot is a curved guide slot, said unlocking hand knob is a rotatable hand knob, and said rotatable hand knob is rotatably fixed with said housing.

5. The chair arm that is rotatably folded and assembly-free as set forth in claim 1, further comprising a cam is formed on said locking member, a recess formed on said unlocking hand knob, and said cam disposed in said recess.

6. The chair arm that is rotatably folded and assembly-free as set forth in claim 1, wherein said side of said back panel has a lower portion to which said pin is fixed, and said arm has a lower back portion to which said arm housing is fixed.

7. The chair arm that is rotatably folded and assembly-free as set forth in claim 1, wherein said arm housing is integrally formed on said arm.

8. The chair arm that is rotatably folded and assembly-free as set forth in claim 1, wherein said back panel is connected with said arm via a common axial hole.

9. The chair arm that is rotatably folded and assembly-free as set forth in claim 1, wherein said slide slot is a short section of curved slide track and when said back panel is rotated, a screw hole on a top end of said arm functions as a rotation center.

10. The chair arm that is rotatably folded and assembly-free as set forth in claim 1, further comprising a rivet head formed on said side of said back panel, a screw hole formed in said arm, and a screw running through said screw hole and said rivet head.

* * * * *